United States Patent [19]

Massonnet

[11] Patent Number: 4,658,720

[45] Date of Patent: Apr. 21, 1987

[54] REFUSE BIN INCORPORATING COMPACTING MEANS

[76] Inventor: Henry Massonnet, 01760 Nurieux-Volognat, France

[21] Appl. No.: 864,487

[22] Filed: May 19, 1986

[30] Foreign Application Priority Data

May 21, 1985 [FR] France ..... 85 07818

[51] Int. Cl.[4] ..... B30B 15/06

[52] U.S. Cl. ..... 100/226; 53/527; 100/246; 100/295; 220/1 T

[58] Field of Search ..... 100/240, 245, 246, 247, 100/295, 226; 220/1 T; 141/73, 80; 53/527

[56] References Cited

U.S. PATENT DOCUMENTS 3,946,662 3/1976 Ross ..... 100/240
4,331,074 5/1982 Behman ..... 100/246 X

FOREIGN PATENT DOCUMENTS 1923396 11/1970 Fed. Rep. of Germany ..... 100/245
2135322 5/1972 France .
7903519 11/1980 Netherlands ..... 100/240

*Primary Examiner*—Billy J. Wilhite
*Attorney, Agent, or Firm*—Dowell & Dowell

[57] ABSTRACT

This invention relates to improvements in refuse bins incorporating compacting means for domestic use, wherein the compacting plate comprises two upwardly oriented tabs which are placed in housings in the lid to be slidably associated with a control member. Catches facing opposite each other and borne by said tabs come into slides in the control member embedded in a groove in the lid. In this way, by subjecting the control member to a translation, it may, at the end of a stroke, be pivoted with respect to the catches in order to orient it vertically with a view to vertically actuating the compacting plate.

9 Claims, 7 Drawing Figures

REFUSE BIN INCORPORATING COMPACTING MEANS

BACKGROUND OF THE INVENTION

1. Field of the Invention

The present invention relates to improvements in refuse bins incorporating compacting means, for domestic use.

2. History of the Prior Art

FR-A-2 135 322 discloses a refuse bin of the type in question, comprising:

an upwardly open bin;

a lid articulated on the bin;

a compacting plate disposed inside the bin and comprising two upwardly oriented tabs which pass through the lid and comprise means for sliding and pivoting association with the manoeuvring rod which rests on the lid. By subjecting this rod to a translation, the latter may, at the end of stroke, be pivoted with respect to said means of the tabs in order to orient it vertically with a view to actuating the compacting plate downwardly and upwardly.

However, the position of the manoeuvring rod on the lid is neither practical nor aesthetic.

Moreover, assembly of the low end of the manoeuvring rod and of the compacting plate necessitates a pusher system controlled by a handle, the whole being complex and uneconomical.

SUMMARY OF THE INVENTION

It is an object of the improvements according to the present invention to overcome these drawbacks and to allow a compacting refuse bin to be produced which responds better than heretofore to the desiderata of the users.

To this end, the tabs of the compacting plate come, in high position of the latter, into housings in thc lid opcning out in a longitudinal groove made in the top of the latter and which slidably contains thc plate controlling member so that the catches come into this groove and penetrate in known manner in two longitudinal slides made in the two opposite longitudinal faces of the control member.

According to another feature of the invention, the slides of the plate control member comprise two notches thanks to which the catches of said plate may be engaged in these slides in a position thereof which is never presented during operation.

According to another feature of the invention, the active end of the plate control member comprises a depression in which a fixed projection on this plate penetrates in order to lock the member perpendicularly to the latter and be automatically released as soon as the member is pulled upwardly.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
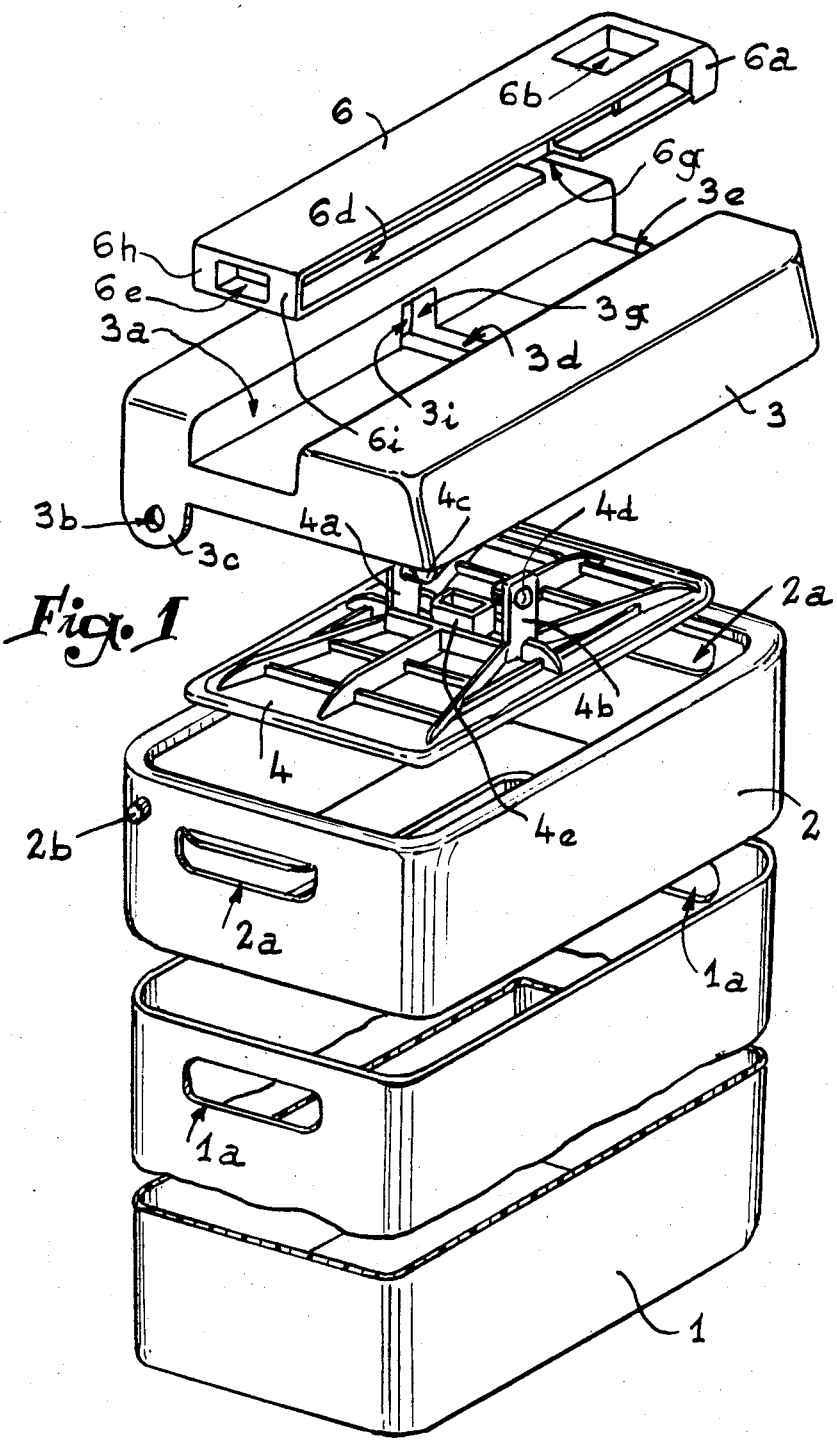
FIG. 1 is an exploded view in perspective of a compacting refuse bin incorporating the improvements according to the invention.
Figure 2:
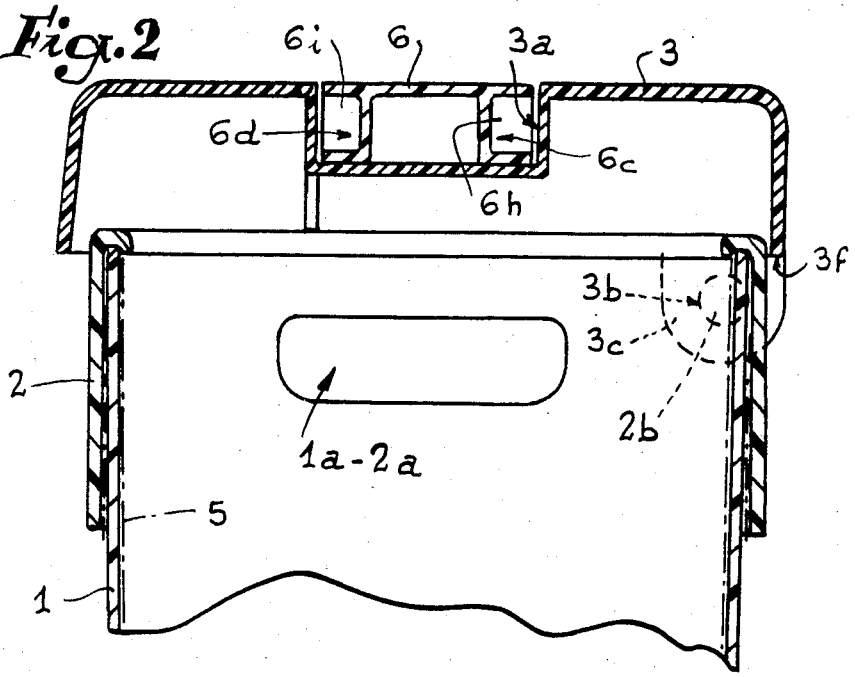
FIG. 2 is a transverse section of the upper part of the refuse bin according to the invention.

Referring now to the drawings, the refuse bin illustrated in FIG. 1 essentially comprises a bin 1 of rectangular cross section of which the upper part is covered by a frame 2 on which is articulated a lid 3, whilst, inside this bin, a compacting plate 4 may be displaced vertically with a view to compressing the refuse contained in a plastic bag. The latter is disposed inside the bin and its opening is wedged between the frame 2 and the upper part of bin 1, as illustrated in FIG. 2 et seq., the bag being referenced 5 and shown schematically in broken lines. Openings 1*a* and 2*a* are made in register in the bin and the frame respectively, so that, by passing his hands through these openings, the user grips these two elements without separating them.

As illustrated in FIG. 1, the compacting plate 4 is adapted to be associated with a control member 6 which is normally, i.e. not during periods of compacting, located in a groove 3*a* in the lid 3. The latter pivots with respect to frame 2 via pins 2*b* on the latter which engage in perforations 3*b* made in lugs 3*c* on lid 3.

It is observed that groove 3*a* is traversed by an opening 3*d* located at the centre thereof and which is intended, on the one hand, for the passage of the control member 6 during compacting and, on the other hand, to allow permanent assembly of this member and of the compacting plate 4.

The latter comprises a network of reinforcing ribs issuing from a central vertical extension composed of two vertical tabs 4*a*, 4*b* of which the opposite faces each bear a catch 4*c*, 4*d* comprising a common horizontal geometrical axis. Between the two tabs 4*a* and 4*b* is located a hollow projection 4*e* whose role will be set forth hereinbelow.

Figure 5:
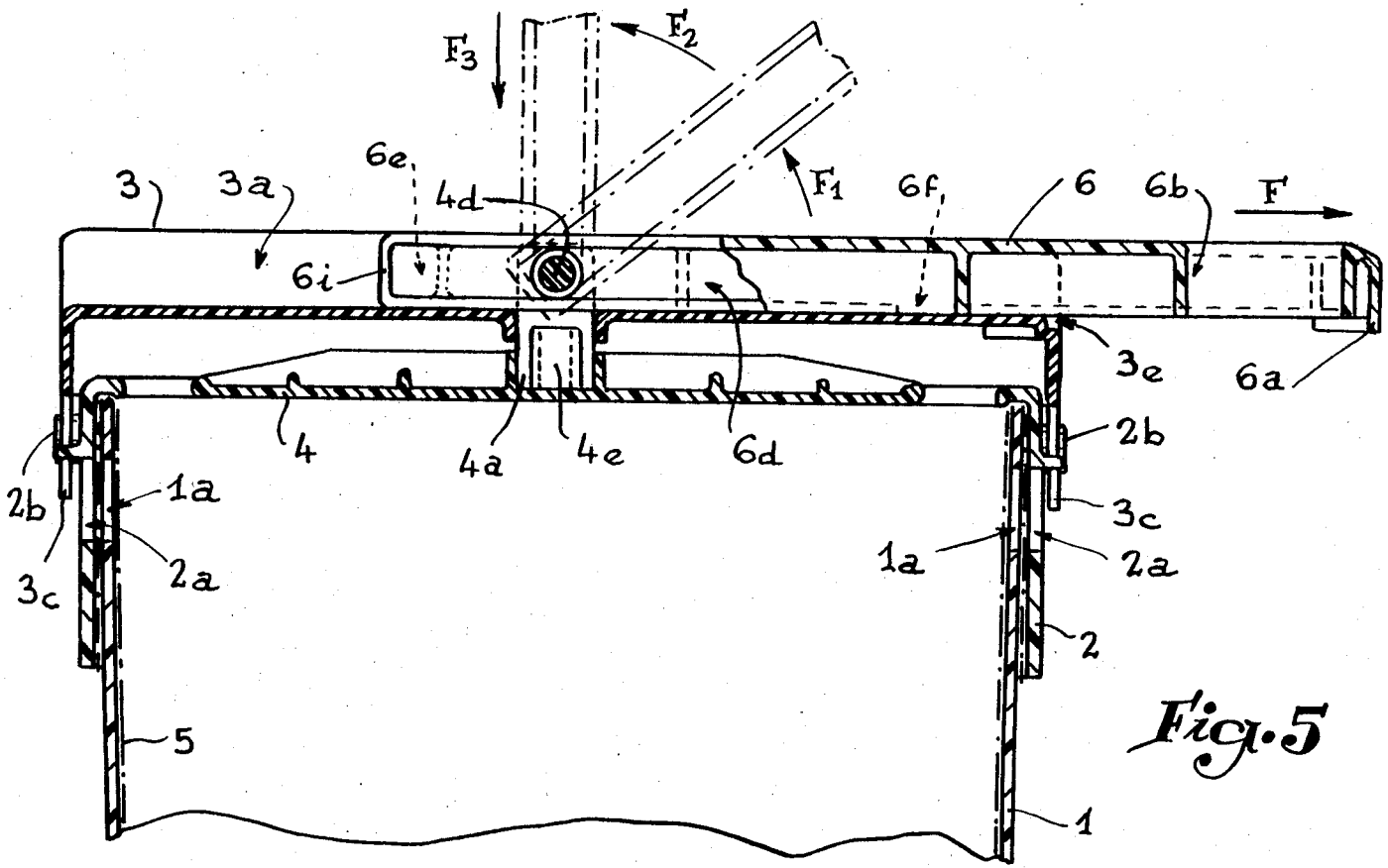
FIG. 5 is a longitudinal section of the upper part of the refuse bin according to the invention showing the manner in which the plate control member is displaced from its rest position to its active position.

The control member 6 is in the form of a rectangular parallelepiped whose length corresponds to that of lid 3 and whose section is identical to that of groove 3*a* (FIG. 2), with the result that this member is embedded in the lid. One of the ends of member 6 comprises a downwardly projecting gripping handle 6*a* which engages in a hollow 3*e* made at one of the ends of groove 3*a*. In this way, as will be emphasized hereinafter, the outward slide of member 6 in groove 3*a* can only be effected in the direction of arrow F of FIG. 5. Member 6 further comprises an opening 6*b* adjacent handle 6*a* and facilitating gripping thereof. The two longitudinal faces of member 6 are hollow so as to determine two slides 6*c*, 6*d* whose height is slightly greater than the diameter of catches 4*c*, 4*d*. The end of member 6 opposite its handle 6*a* is provided with a depression 6*e* of section complementary to that of projection 4e of the compacting plate 4.

Figure 6:
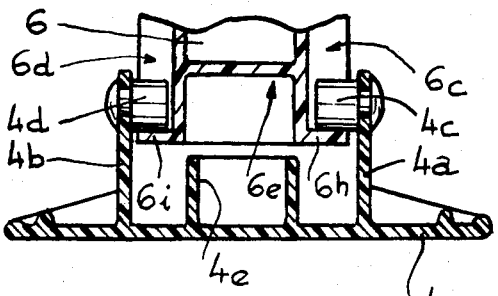
FIG. 6 is a detailed view showing thc control mcmber in vertical position before the projection on the lid is fitted in the terminal depression of the control member.
Figure 3:
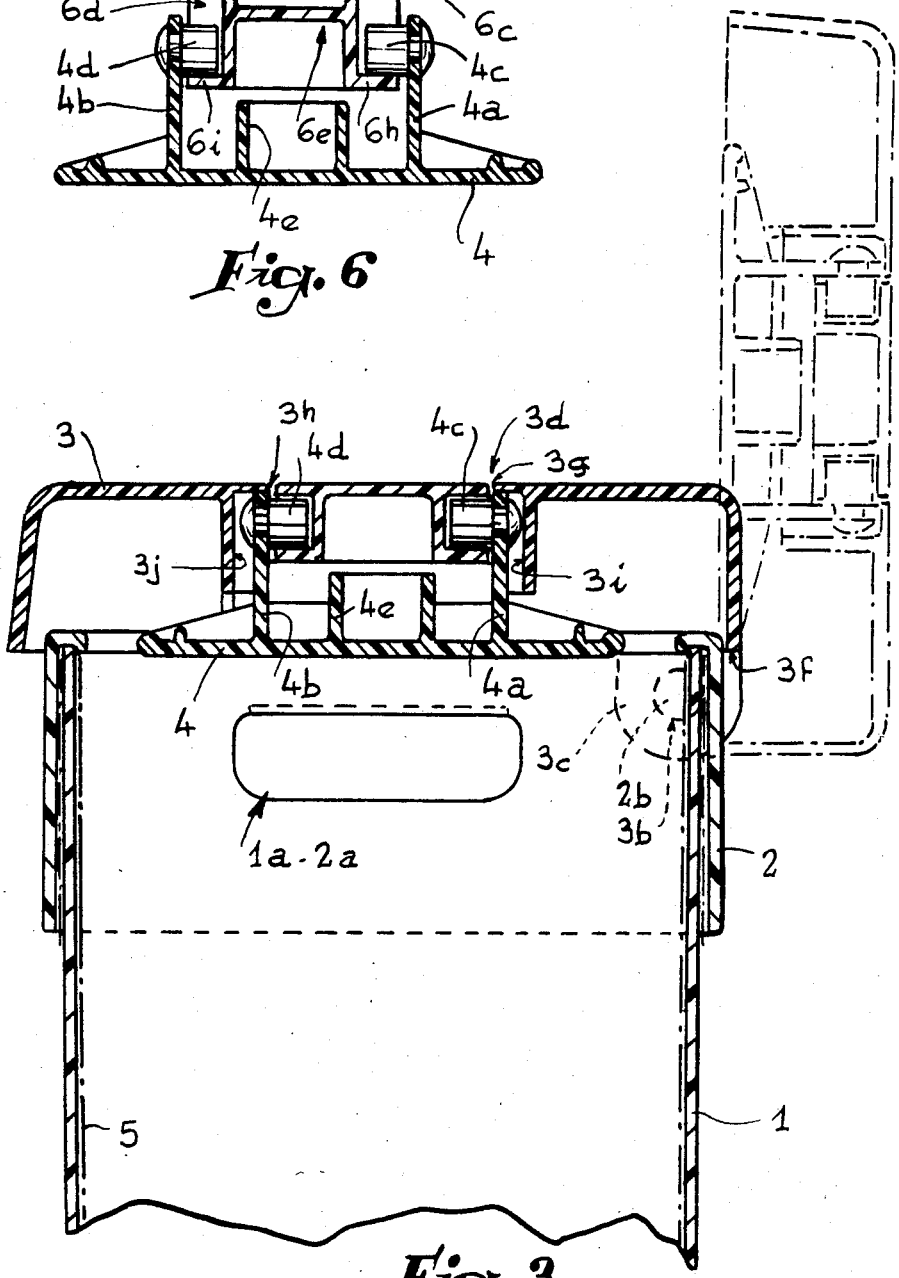
FIG. 3 is a view similar to that of FIG. 2, but made in the centre of the refuse bin, so as to show the assembly of the control member and of the compacting plate.
Figure 4:
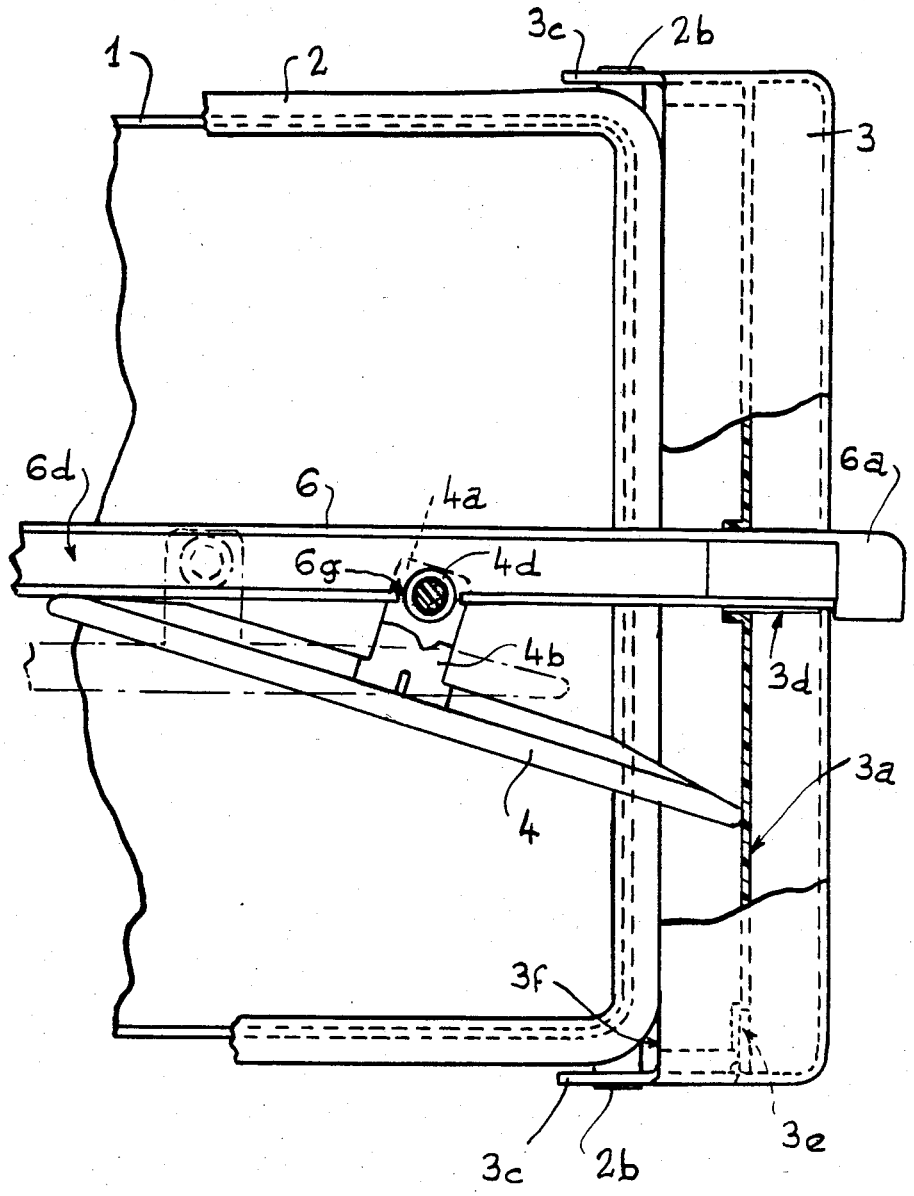
FIG. 4 shows the manner in which the compacting plate is positioned in the slides of its control member.

FIG. 4 illustrates the refuse bin according to the invention in a partial plan view, its lid 3 being open as illustrated in discontinuous lines in FIG. 3, i.e. it has been pivoted about pins 2b of frame 2, so that its rear edge 3f comes into abutment against the corresponding face of the frame so as to constitute stop of maximum opening. In this position, the control member 6 is introduced horizontally in the opening 3b in the lid, so that it is presented horizontally once its handle 6a abuts against the top of said lid. As the two slides 6c, 6d of member 6 each comprise a notch 6f, 6g, if the compacting plate 4 is presented in vertical position with its tabs 4a, 4b turned towards notches 6f, 6g, catches 4c, 4d may be made to penetrate in slides 6c, 6d further to the position of notches 6f, 6g. Arrangements are such that, in no position of the control member 6 during operation do the catches 4c, 4d ever come to the level of notches 6f, 6g. In fact, once said catches are engaged in slides 6c, 6d of member 6, any axial displacement of the latter is made in the zone included between these notches and its end opposite handle 6a. It is noted in particular on this subject that member 6 cannot be displaced in the direction opposite that of arrow F of FIG. 5 beyond the position of abutment of the handle 6a against the hollow 3e. The catches are then made to slide in slides until they come into abutment against end stops 6h, 6i of the slides opposite handle 6a (FIG. 6), then the plate is pivoted so that it is oriented perpendicularly to its manoeuvring member 6 (FIG. 6). The manoeuvring member is then withdrawn outwardly by sliding it in opening 3d in lid 3 until plate 4 comes against the underneath of lid 3. The opening 3d of the lid comprises two lateral cut-outs 3g, 3h by which open out into groove 3a two housings 3i, 3j into which come tabs 4a, 4h in high position of the plate 4, the catches 4c, 4d then being crosswise in said groove whilst being engaged in the slide of member 6, as illustrated in FIG. 3. In this way, an articulation is constituted between this member and plate 4. Finally, the lid is closed and the control member 6 is folded down to the horizontal with respect to plate 4, so that it rests in groove 3a in the lid. The latter is displaced axially until it no longer projects from said lid, the handle 6a cooperating with the hollow 3e. The refuse bin is then in rest position, i.e. not in use.

Figure 7:
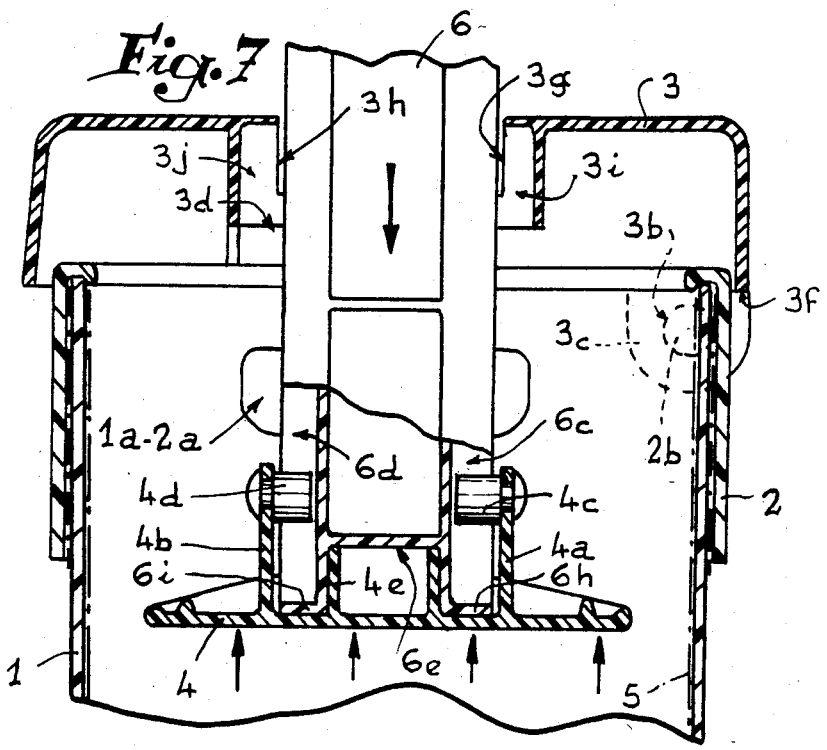
FIG. 7 illustrates the manner in which compacting is effected.

If a user desires to place refuse in the bin, it suffices to open the lid, pour the refuse into bag 5, and to close the lid again. If he then desires to compress the products deposited in the bag, he extracts the manoeuvring member by subjecting it to a longitudinal translation in the direction of arrow F of FIG. 5, such translation bringing the two catches 4c, 4d to near the end of the member 6 opposite its handle 6a. Under these conditions, it is possible to pivot member 6 to bring it to the vertical in the direction of arrows Fl and F2 of FIG. 5. The following operation consists in vertically lowering the manoeuvring member downwardly in the direction of arrow F3. When plate 4 comes into contact with refuse, it is immobilized whilst member 6 may be descended a little more in order to engage the projection 4e of this plate in the depression 6e of the manoeuvring member 6 (FIG. 7). In this way, the angular positions of these two elements are locked and compacting may be practised without pivoting the plate 4.

Return into position is effected in reverse. When the member 6 is withdrawn by a vertical displacement, tabs 4a, 4b of the plate come into housings 3i, 3j of the lid against the bottom of which they abut in order to allow disengagement of the projection 4e with respect to the end depression 6e of the member 6. The latter returns into the position illustrated in FIG. 2, so that it may again pivot with respect to catches 4c and 4d in order to be placed in horizontal position in the groove 3a of the lid. This member is then returned into its rest position by sliding in the direction opposite that of arrow F of FIG. 5.

A compacting refuse bin has thus been produced of which the compacting plate is actuated by a control member which, in rest position, is perfectly included within the general volume of the bin.

It goes without saying that the article forming the subject matter of the present invention may be made of any appropriate materials, but that its different elements are advantageously made by moulding a plastics material under pressure.

It will be noted that the handle 6a abuts against the bottom of groove 3a if the manoeuvring member 6, placed vertically, is released by the user when the bin is empty.

It must, moreover, be understood that the foregoing description has been given only by way of example and that it in no way limits the domain of the invention which would not be exceeded by replacing the details of execution described by any other equivalents.

What is claimed is:

1. A compaction refuse receptacle comprising a bin having an open top portion, a lid selectively mounted to said top portion of said bin and having an elongated recess formed therein, an opening into said bin disposed within said recess, a compactor assembly carried by said lid, said compactor assembly including a compaction plate disposed within said bin and an elongated control member which is cooperatively seated within said recess, mounting means connected to said compaction plate so as to be extendable through said opening so as to be disposed within said recess, said control member having first and second ends and being slideably and pivotally connected to said mounting means within said recess, said control member being selectively movable from a first position within said recess which position is generally parallel with said lid to a second position wherein said control means is generally perpendicular to said lid and aligned for movement through said opening with said first end thereof engaging said compaction plate to thereby permit said control member to selectively urge said compaction plate downwardly relative to said lid within said bin.

2. The compaction refuse receptacle of claim 1 in which said mounting means includes a pair of spaced tab means extending upwardly with respect to said compaction plate, a pair of inwardly extending and generally aligned catch means carried by said pair of spaced tab means, said control member having a pair of oppositely oriented channels formed along a substantial portion of the length and intermediate said first and second ends thereof, said catch means being slideably disposed within said opposing channels and being located within said recess in said lid when said control member is in said first position.

3. The compaction refuse receptacle of claim 2 including a projection means mounted to said conpaction plate so as to be located between said tab means, a socket formed in said first end of said control member, said projection means being selectively receivable within said socket when said control member is oriented in said second position for movement through said opening in said lid so as to stablize the connector between said compaction plate and said control member as said compaction plate is urged inwardly of said bin.

4. The compaction refuse receptacle of claim 3 wherein said second end of said control member includes a handle means, said handle means being engagable so as to urge said control member longitudinally within said elongated recess in said lid.

5. The compaction refuse receptacle of claim 4 including means to pivotally connect said lid relative to said bin.

6. The compaction refuse receptacle of claim 4 including a frame means selectively engagable about said top portion of said bin, said lid being pivotally connected to said frame means.

7. A compaction refuse receptacle of the type for selectively receiving a disposable refuse bag therein comprising an upwardly open bin having an upper open end defined by edge portions, a frame mounted to said upper end of said bin and cooperating with said edge portions of said bin so as to retain the open end of the refuse bag which is selectively disposed within said bin, a lid articulated on said frame and having an elongated recess therein, an opening with said recess through said lid, a compaction plate disposed inside said bin, said compaction plate having two upwardly oriented tabs of a size to pass through said opening in said lid and terminate within said recess, each of said tabs having a catch, said catches facing each other along the same horizontal geometrical axis, a control member carried by said lid and being cooperatively receivable within said recess, said control member having first and second ends and a pair of oppositely oriented guide channels therein which extend intermediate of said first and second ends, said guide channels normally being oriented within said recess when said control member is seated within said recess, said catches on said tabs being slideably disposed within said guide channels, said control member being selectively longitudinally aligned with said opening in said lid so that said first end thereof is oriented within said bin, said compaction plate being urged inwardly of said bin as said control member is moved inwardly with respect to said bin and being raised toward said lid as said control member is urged outwardly with respect to said bin.

8. The compaction refuse receptacle of claim 7 including a socket within said first end of said control member, a projection means disposed on said compaction plate, said socket being selectively mounted over said projection means so as to securely align said control member with respect to said compaction plate.

9. The compaction refuse receptacle of claim 8 including a slot in each of said guide channels, said catches being selectively insertable through said slots so as to be positioned within said channels, said slots being positioned adjacent said second end of said control member so as to be spaced from said catches when said control member is inserted within said bin.

* * * * *